US009271091B2

(12) United States Patent
Zurbrugg

(10) Patent No.: US 9,271,091 B2
(45) Date of Patent: Feb. 23, 2016

(54) OWN VOICE SHAPING IN A HEARING INSTRUMENT

(71) Applicant: Phonak AG, Stafa (CH)

(72) Inventor: Thomas Zurbrugg, Zurich (CH)

(73) Assignee: SONOVA AG, Stafa (CH)

( * ) Notice: Subject to any disclaimer, the term of this patent is extended or adjusted under 35 U.S.C. 154(b) by 0 days.

(21) Appl. No.: 14/442,820

(22) PCT Filed: Nov. 15, 2012

(86) PCT No.: PCT/CH2012/000254
§ 371 (c)(1),
(2) Date: May 14, 2015

(87) PCT Pub. No.: WO2014/075195
PCT Pub. Date: May 22, 2014

(65) Prior Publication Data

US 2015/0304782 A1 Oct. 22, 2015

(51) Int. Cl.
*H04R 25/00* (2006.01)
*H04R 1/08* (2006.01)

(52) U.S. Cl.
CPC . *H04R 25/50* (2013.01); *H04R 1/08* (2013.01)

(58) Field of Classification Search
CPC ..... H04R 3/005; H04R 25/70; H04R 25/356; H04R 25/402; H04R 25/405; H04R 25/407; H04R 25/453; H04R 25/505; H04R 25/552; H04R 25/554; H04R 25/502; H04R 2225/41; H04R 2225/43
USPC ..... 381/71.1, 312, 313, 317, 320, 322, 324; 600/25, 559; 623/10; 340/573.1, 540
See application file for complete search history.

(56) References Cited

U.S. PATENT DOCUMENTS 6,728,385 B2 * 4/2004 Kvaløy ..... H04R 1/1016 381/317
7,039,195 B1 * 5/2006 Svean ..... A61F 11/08 381/71.1

(Continued)

FOREIGN PATENT DOCUMENTS

EP 1 640 972 A1 3/2006
EP 2 040 490 B1 3/2009
EP 2 434 780 A1 3/2012

(Continued)

OTHER PUBLICATIONS

International Search Report for PCT/CH2012/000254 dated May 23, 2013.

*Primary Examiner* — Brian Ensey
(74) *Attorney, Agent, or Firm* — Pearne & Gordon LLP

(57) ABSTRACT

A method of processing a signal in a hearing instrument with at least one outer microphone oriented towards the environment, an ear canal microphone oriented towards the user's ear canal, and at least one receiver capable of producing an acoustic signal in the ear canal includes the steps of:

Processing a first signal from the outer microphone and a second signal from the inner microphone to yield an ambient sound portion signal estimate and an own voice sound portion signal estimate;

Processing the ambient sound portion signal estimate into a processed ambient sound portion signal;

Processing the own voice sound portion signal estimate into a processed own voice sound portion signal; and Adding the processed ambient sound portion signal and the processed own voice portion signal for obtaining an input for the receiver.

14 Claims, 3 Drawing Sheets

(56) References Cited

U.S. PATENT DOCUMENTS

| | | | |
|---|---|---|---|
| 2007/0009122 | A1 | 1/2007 | Hamacher |
| 2010/0027823 | A1 | 2/2010 | Arndt |

FOREIGN PATENT DOCUMENTS

| | | | |
|---|---|---|---|
| WO | 03/032681 | A1 | 4/2003 |
| WO | 2004/021740 | A1 | 3/2004 |

* cited by examiner

OWN VOICE SHAPING IN A HEARING INSTRUMENT

FIELD OF THE INVENTION

The invention is in the field of processing signals in hearing instruments. It especially relates to methods and devices for own voice separation, own voice shaping, and/or occlusion effect minimization.

BACKGROUND OF THE INVENTION

An important issue in signal processing in hearing instruments is perception of the own voice by a hearing instrument user.

The own voice reaches the tympanic membrane via two different paths:

- Air conduction: the main contribution as long as the ear canal is not occluded
- Bone conduction: a significant contribution as soon as the ear canal is at least partially occluded.

These two contributions undergo an acoustic summation in the ear canal before being perceived.

The naturalness and pleasantness of this perception among others may depend on three distinct aspects:

- Occlusion (increased low-frequency contents of the bone conducted portions of the own voice)
- Ampclusion (increased low-frequency contents of the hearing instrument sound, including the air-conducted portion of the own voice);
- Individual preferences (users might have gotten used to an 'unnatural' (influenced by their hearing capabilities) perception of the own voice or prefer their own voice to sound differently, for example less squeaky, from what would be 'natural').

In traditional hearing instruments, only the air conducted portion of the own voice can be affected by the processing (i.e. ultimately the frequency dependent amplification). A hearing instrument featuring active occlusion control can additionally affect—i.e. frequency-dependently decrease—the bone-conducted portion.

Even if the occlusion—especially the unwanted increase of low-frequency contents of the bone-conducted portion of the own voice—is fully removed by the active occlusion control, there is still a trade-off in terms of ampclusion. Specifically, the optimal setting of the hearing instrument gain in terms of ambient sounds might not be optimal in terms of the own voice.

In order to solve this problem, the state of the art proposes to detect own voice activity and to then, during own voice activity, temporarily change the hearing instrument settings so that they are optimal for the perception of the own voice.

WO 2004/021740 discloses such an example where an ear canal microphone is used to detect conditions leading to occlusion problems. EP 2 040 490 discloses approaches to detect ampclusion effect situations by a MEMS sensor. In order to account for the ampclusion effect and also for individual preferences, WO 03/032681 discloses to hold a training session in which the user may adjust parameters until the processed own voice is perceived as having a satisfying sound quality. The parameter values are stored and used when the own voice is detected.

However, the temporal change in the hearing instruments settings implies that the perception of ambient sounds is different while the user speaks than when he is quiet.

The state of the art does not propose any solution to this problem.

SUMMARY OF THE INVENTION

It is an object of the invention to provide approaches overcoming drawbacks of prior art approaches and especially to provide a method and a hearing instrument that make possible to shape the own voice in a manner pleasant for the user also in closed fitting set-ups.

This object is achieved by the method and the hearing instrument as defined in the claims.

A method of processing a signal in a hearing instrument with at least one outer microphone oriented towards the environment, an ear canal microphone oriented towards the user's ear canal, and at least one receiver capable of producing an acoustic signal in the ear canal comprises the steps of:

- Processing a first signal from the outer microphone and a second signal from the inner microphone to yield an ambient sound portion signal estimate and an own voice sound portion signal estimate;
- Processing the ambient sound portion signal estimate into a processed ambient sound portion signal;
- Processing the own voice sound portion signal estimate into a processed own voice sound portion signal;
- Adding the processed ambient sound portion signal and the processed own voice portion signal for obtaining the acoustic signal in the ear canal.

In this, the adding may comprise adding the processed ambient sound portion signal and the processed own voice portion signal for obtaining an input for the at least one receiver. Alternatively, if two separate receivers for the respective processed signals are used, the adding may be an acoustical adding.

In the former case, the added signal obtained from adding the processed ambient sound portion and own voice portion signals may directly constitute the receiver signal (i.e. the signal fed to the receiver under Digital-to-analog conversion) or may be further processed prior to being fed to the receiver, for example by a possibly situation dependent amplification characteristics.

The acoustic signals incident on the outer microphone and on the inner microphone each comprise a mixture of signal portions coming from ambient sound—influenced, by the presence of the person and of the hearing instrument—and signal portions coming from the own voice—also influenced by the presence of the person and of the hearing instrument.

It is a first insight of the invention that because on the paths to the outer and inner microphone(s), respectively, the signal portions are influenced in different manners, and that this makes a separation of the signal portions possible.

It is a second insight of the invention that the signal portions (estimates for the ambient sound portion and own voice portion of the outer microphone signal) can be processed differently and simultaneously to yield, after summation, a receiver signal.

For estimating the ambient sound signal portion and the own voice portion, different approaches may be used.

Especially, in accordance with a first possibility, statistical signal separation techniques can be used. Such methods may be without the aid of information on the source signal properties and signal paths, or they may use the aid of such information. Such statistical methods base on the assumption that the ambient sound portion and the own voice portion are statistically independent. An example of a statistical method is blind source separation.

In accordance with a second possibility, signal processing is carried out based on pre-defined processing steps processing the signals from the inner microphone and from the outer microphone into an ambient sound signal portion and a own voice signal portion.

In accordance with a group of examples, an estimate of the own voice signal portion is obtained and subtracted from the (optionally pre-processed) outer microphone signal to yield the ambient sound signal portion. In this group of embodiments, the processing of the outer microphone signal into a receiver signal comprises the steps of subtracting an estimate of an own voice signal to yield an estimate of the ambient sound signal portion, processing the ambient sound portion signal estimate, processing the own voice portion signal estimate, and adding the processed ambient and own voice portion signals to yield an added signal that serves, unprocessed or further processed—as the receiver signal.

The own voice signal portion may be obtained, (for example, if no relevant direct sound component is present/to be expected), by subtracting the receiver signal from the inner microphone signal.

In this, two corrections can be made:

- A first correction may account for the receiver response, the inner microphone response, and (as inherent part of the receiver-to-microphone transfer function), the influence of the signal path from the receiver to the inner microphone. For this first correction, a transfer function, especially a filter function may be applied to the receiver signal before the latter is subtracted from the inner microphone signal. The first correction is applied on the receiver signal prior to its subtraction from the inner microphone signal. What results is an estimate of the own voice portion of the inner microphone signal.
- The first correction may also be viewed as determining an estimate of a receiver generated inner microphone signal portion rRM and subtracting the same from the inner microphone signal.
- A second correction accounts for the difference between the signal paths from the source of the own voice (vocal cords, resonating elements) to the inner microphone on the one hand and to the outer microphone on the other hand, as well as, (potentially negligible) the difference between the inner microphone response and the outer microphone response. The second correction is applied to the own voice portion of the inner microphone signal prior to its subtraction from the outer microphone signal.
- The second correction may be viewed as estimating from the own voice portion of the inner microphone signal, an own voice portion of the outer microphone signal. This may for example be done by a function, such as a filter, that takes into account the differences of the sound paths from own voice generation (vocal cords, resonating bodies etc.) to the inner and to the outer microphone respectively. This function (filter or the like) may also take into account different characteristics of the inner and outer microphones if such differences are relevant.
- The own voice portion of the outer microphone signal may be subtracted from the outer microphone signal to yield the ambient sound portion of the outer microphone signal.

Especially in open fitting set-ups a third correction may be advantageous which accounts for the direct sound incident on the inner microphone, which is often expressed in terms of the Real Ear Occluded Gain (REOG). This third correction may especially be advantageous if direct sound portions of ambient sound are not negligible, such as in open fitting set-ups, if a vent has a comparably large diameter or is comparably short, etc. The third correction is applied to the inner microphone signal after subtraction of the receiver generated portion.

Such estimate of the direct sound portion of ambient sound may for example be obtained from applying a value for the REOG on the outer microphone signal (if necessary and applicable corrected for different microphone characteristics).

The ambient sound portion of the outer microphone signal and the own voice portion of the outer microphone signal are then processed differently on the different paths.

Implemented in the hearing instrument, a filter making the first correction (and/or a filter making a third correction, if applicable), may be considered to belong to the separator unit. Alternatively, it/they may also be seen as pre-conditioning filter(s) for the actual separator unit comprising the filter for the second correction.

For the first and/or second corrections and/or the third correction, an adaptive filter/adaptive filters may be used.

For the first correction, the corrected (filtered) receiver signal is such that all portions of the inner microphone signal that correlate with the receiver signal are subtracted from the inner microphone signal. What remains is the portions that do not correlate with the receiver signal, i.e. that are not caused by the receiver and are thus caused by the own voice (especially bone conducted portions), and, as the case may be, by direct sound. Therefore, the difference between the inner microphone signal and the filtered receiver signal may be used as the error signal input of the adaptive filter (or, to be precise, as an error signal input of an update algorithm of the adaptive filter). Corresponding filter update algorithms that minimize an error signal are known in the art, for example base on the so-called LMS (Least Mean Squares) or RLS (Recursive Least Squares).

For the second correction, the insight is used that that portion of the outer microphone signal which correlates with the own voice portion of the inner microphone signal is the own voice portion of the outer microphone signal. Therefore, the ambient sound signal portion that results after subtraction of the own voice portion may serve as an error signal to be minimized by the filter.

In a specific embodiment, the signal separation is based on two adaptive filters. The first filter (herein denoted as P-filter) accounting for the first correction allows to subtract the accordingly P-filtered receiver signal from the inner microphone signal resulting in an estimate ($\hat{v}'$) of the own voice portion of the inner microphone signal. The second filter (herein denoted as H-filter) accounts for the second correction and allows to obtain the own voice portion of the outer microphone signal as the H-filtered own voice portion of the inner microphone signal.

Still further, in embodiments, if the direct sound portions of ambient sound are subtracted from the direct sound estimate, a static filter may be used to estimate the direct sound portions of ambient sound from the outer microphone signal. Alternatively, and adaptive filter may be used for this purpose.

The invention also concerns a hearing instrument equipped for carrying out the method according to any one of the embodiments described in the present text.

Especially, in accordance with an aspect of the invention, a hearing instrument comprising at least one outer microphone (a microphone oriented towards the environment, capable of converting an acoustic signal incident on the ear into an electrical signal) and at least one ear canal microphone (i.e. a microphone in acoustic communication/connection with the ear canal, capable of picking up noise signals from the volume between an earpiece of the hearing instrument and the tympanic membrane) is used. The ear canal microphone is also denoted "inner microphone" in this text. The hearing instrument comprises an own voice separator. The own voice separator separates, based on signals from the outer microphone(s) and the inner microphone(s), the signal from the outer microphone(s) into an ambient sound portion and an own voice portion. The hearing instrument comprises two separate signal processing paths set up in parallel, one for ambient sounds, and the other one for the own voice processing. The signals on the two signal paths are processed differently and simultaneously, for example by applying different frequency dependent amplification characteristics and/or by implementing a gain $G_v$ on a low latency path because the high latency of the hearing instrument is said to be perceived more disturbing for the own voice than for ambient sound. The processed signals on the two paths are summed to a receiver signal before fed to the hearing aid receiver(s).

The outer microphone or outer microphones can be placed, as is known for hearing instruments, in the ear, especially in the earpiece (in case of a Completely-in-the Canal-(CIC), in-the-canal- (ITC), or in-the-Ear- (ITE) hearing instrument) in acoustic communication/connection with the outside so as to predominantly pick up acoustic signals from the outside. The outer microphone(s) may also be placed in a behind-the-ear (BTE) component of the hearing instrument, or in a separate unit communicatively coupled to the rest of the hearing instrument.

A method of fitting a hearing instrument of the kind described herein may comprise fitting of the own voice processing on the corresponding path by means of voice samples. To this end, a user wearing the hearing instrument may be instructed to speak, especially in a quiet room. Depending on the user's perception of his own voice, the processing parameters of the own voice portion sound processing path may be adapted until the user is comfortable with the perception of her/his own voice. Once this has been achieved, the user will remain comfortable with the perceived own voice due to the approach of the invention, even in situations where in addition to the own voice the user hears other sound that is also processed for better audibility in the hearing instrument.

BRIEF DESCRIPTION OF THE DRAWINGS

Hereinafter, embodiments of methods and devices according to the present invention are described in more detail referring to Figures. In the drawings, same reference numbers, letters and symbols refer to same or analogous elements. The drawings are all schematical. The figures show.

DESCRIPTION OF THE PREFERRED EMBODIMENTS

Figure 1:
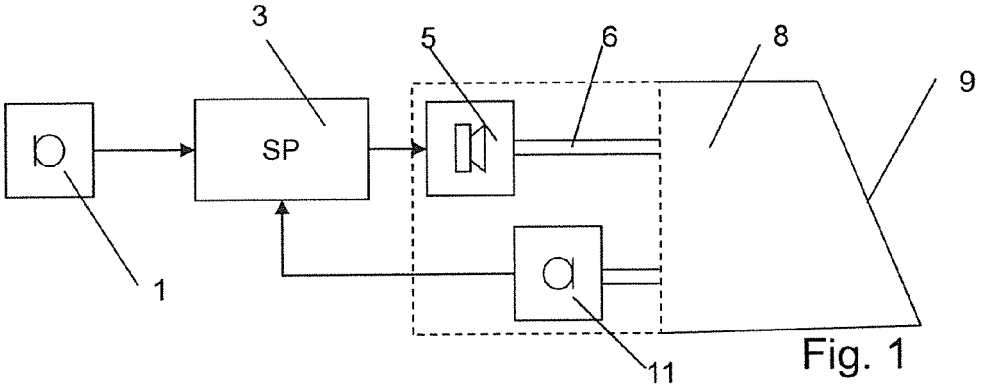
FIG. 1 a simplified scheme of a hearing instrument with an earpiece inserted in an ear so that a remaining volume between the earpiece and the eardrum is defined.

The hearing instrument schematically represented in FIG. 1 may be of the behind-the-ear (BTE) type (including for example RIC (receiver-in-the-canal)=CRT (canal-receiver-technology), of the in-the-ear (ITE) type, (of the completely-in-the-canal (CIC) type or other ITE type) or of any other type. It comprises an outer microphone 1. In practice, often more than one outer microphones are used, and/or in addition to the outer microphone further receiving means for receiving signals may be present, such as a telecoil receiver, a receiving unit with an antenna for receiving wirelessly transmitted signals, etc. The (electrical) input signal obtained from the at least one outer microphone is processed by a signal processing unit 3 to obtain an output signal or receiver signal. The signal processing unit 3 depicted in FIG. 1 may comprise analog-to-digital conversion means and any other auxiliary means in addition to a digital signal processing stage. The signal processing unit may be physically integrated in a single element or may comprise different elements that may optionally be arranged at different places, including the possibility of having elements placed in an earpiece and other parts at an other place, for example in a behind-the-ear unit.

The receiver signal is converted into an acoustic output signal by at least one receiver (loudspeaker) 5 and is emitted into a remaining volume 8 between the user's eardrum 9 and the in-the-ear-canal-component of the hearing instrument. The hearing instrument further comprises an ear canal microphone 11 operable to convert an acoustic signal in the ear canal (in the remaining volume 8 in closed fitting setups) into an electrical signal supplied to the signal processing unit 3.

The ear canal microphone 11 is part of the hearing instrument and present in the earpiece of the hearing instrument or possibly outside of the earpiece and connected to the earpiece by a tubing that opens out into the remaining volume 8.

Figure 2:
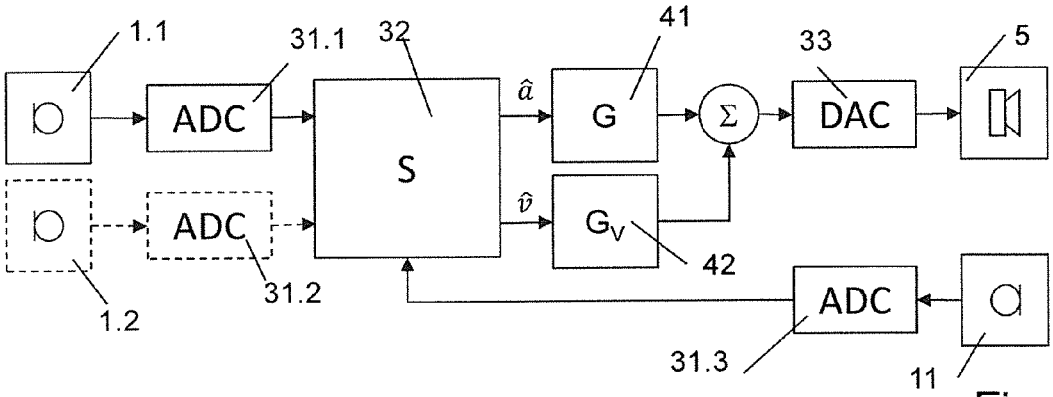
FIG. 2 the concept of two different signal processing paths for the ambient sound and own voice sound.

FIG. 2 depicts signal processing in embodiments of hearing instruments according to the invention. Ambient sound is incident on an outer microphone 1.1 (or on two outer microphones 1.1, 1.2, for example two omnidirectional microphones or an omnidirectional and a directional microphone etc.). The microphone signal or the microphone signals is/are analog-to-digital converted (Analog-to-Digital converter(s) (31.1, 31.2) and then fed to a signal separator 32.

For the discussion of the invention and its embodiments following hereinafter, for the sake of simplicity we only discuss processing the signals from one outer microphone. However, all embodiments of the invention are also suited for processing the input signals of more than one outer microphone.

The signal from the inner microphone 11 is—also after analog-to-digital-conversion 31.3—also fed to the signal separator 32.

By processing both, the signal from the outer microphone and from the inner microphone, the signal separator obtains an estimate $\tilde{a}$ for ambient sound that represents an ambient sound portion of the input signal and an estimate $\tilde{v}'$ for bone conducted own voice sound signal that represents an own voice portion of the input signal.

The ambient sound portion and the own voice portion are processed on different signal processing paths by signal processing stages 41, 42 on which they will typically be subject to a frequency dependent gain G, $G_v$ that is different for the ambient sound portion and for the own voice portion and that, in addition to the frequency, may depend on other parameters, such as settings chosen by the user, (for G) recognized background noise situations etc.

After the processing, the processed ambient sound portion and own voice portion signals are added to obtain a receiver signal r. The receiver signal is, under digital-to-analog conversion (in the digital-to-analog converter 33) fed to the receiver 5.

The signal separator 32 does not need to be and in most cases will not be a separate physical entity but is part of the signal processing means of the hearing instrument; herein it is described as functionally separate processing stage.

In accordance with the above-discussed first possibility, statistical signal separation techniques can be used in the signal separator 32. In accordance with a second possibility, a pre-defined signal processing topology is provided.

In accordance with the second possibility, signal processing is carried out based on pre-defined functions processing the signals from the inner microphone and from the outer microphone into an ambient sound signal portion and a own voice signal portion.

Figure 3:
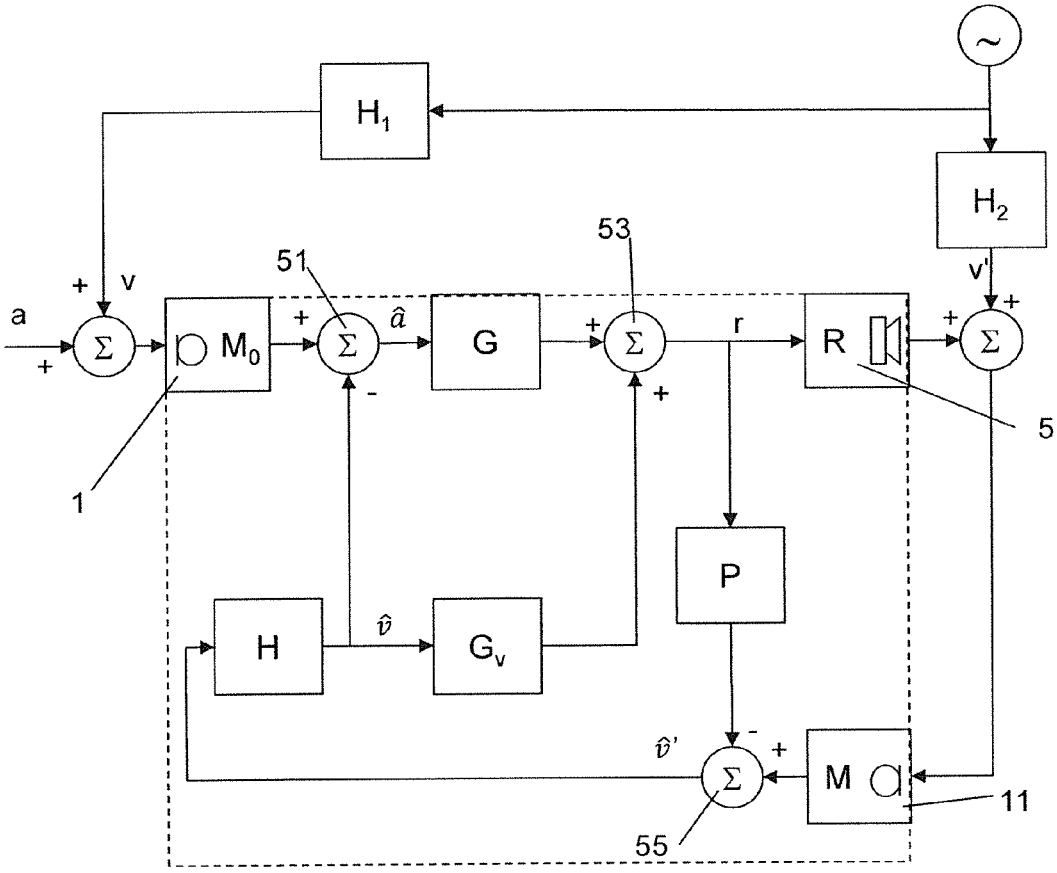
FIG. 3 an embodiment with a signal separator comprising two filters.

FIG. 3 depicts an example of processing an outer microphone signal and an inner microphone signal into a receiver signal r. From the outer microphone signal (transfer function/response of the outer microphone $M_0$), an estimate $\hat{v}'$ of the own voice portion is subtracted (51) to yield an estimate $\hat{a}$ of the ambient sound signal before a frequency dependent gain G (that does not need to be constant and may depend on processing parameters and/or on individual user chosen settings) is applied to the latter. A different frequency dependent gain $G_v$ is applied to the own voice portion estimate $\hat{v}'$, and the accordingly processed ambient sound and own voice signal portions are added (53) to yield the receiver signal r that is fed to the receiver 5. R denotes the receiver response. The alternative gain model (or filter) $G_v$ can optionally be adjusted by the user according to his individual preferences, thus shaping his own voice without compromising the ambient sounds. The two signals components are summed to yield the receiver signal r before being fed to the receiver.

The receiver signal r is also filtered by a first filter P—with a filter function that is an estimate of RM, where M is the response of the inner microphone—and subtracted (55) from the signal picked up by the inner microphone 11. This yields an estimate of the own voice portion $\hat{v}'$ of the inner microphone signal.

This signal $\hat{v}'$ is filtered by a second filter H yielding the estimate of the own voice portion $\hat{v}'$ of the outer microphone signal.

The second filter H has a filter function that is an estimate of $H_1/H_2 \cdot M_0/M$, where $H_1$ is the transfer function of the signal path from the voice source to the outer microphone and $H_2$ is the transfer function of the signal path from the voice source to the inner microphone.

In FIG. 3, a denotes the ambient sound, v the own voice generated sound incident on the outer microphone, and v' the own voice generated sound on the inner microphone.

This scheme is based on the assumption that the influence of the REOG is negligible. If the sound portion directly conducted to the inner microphone is to be taken into account, a further correction can be made, as explained further below.

The filter functions of the filters P, H can be determined based on at least one of

- calculations
- experiments,
- data obtained during the fitting process,
- (especially for H) individual preferences expressed during the fitting process.

Figure 4:
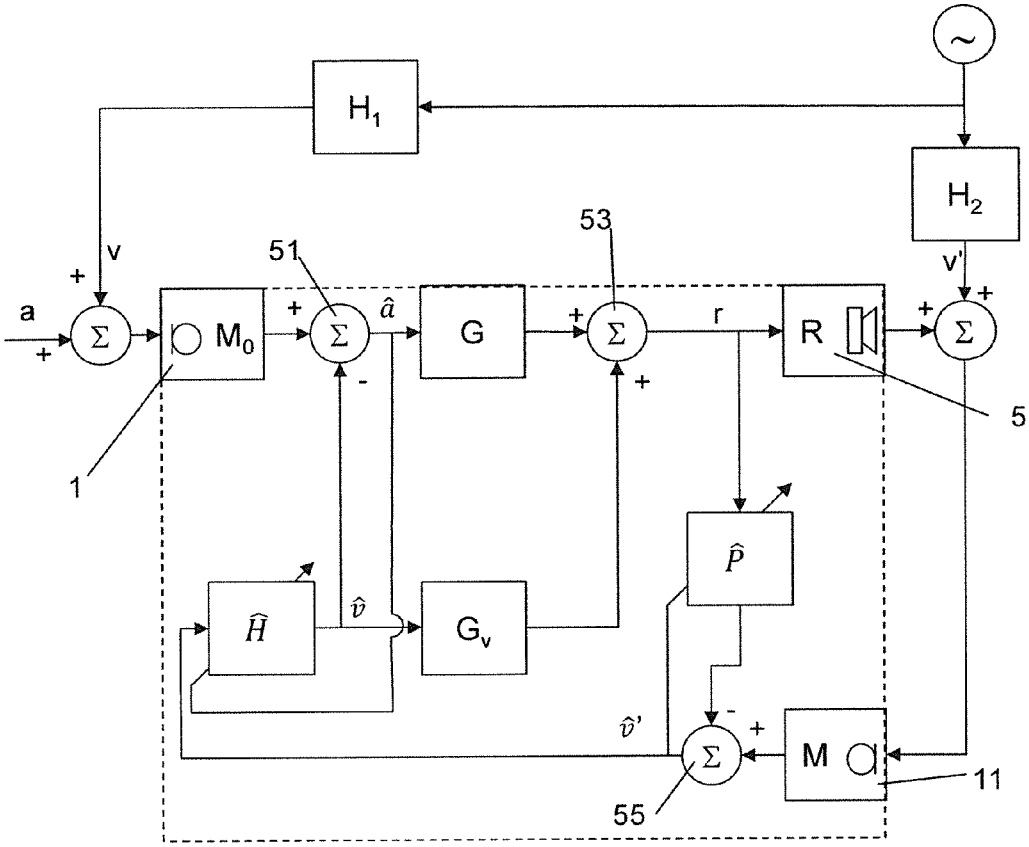
FIG. 4 a variant of the embodiment of FIG. 3, wherein the filters are adaptive filters.

In an alternative embodiment, at least one of the filters P, H is not static but an adaptive filter. This is illustrated in FIG. 4, showing an embodiment where both, the P filter and the H filter are adaptive filters. Only the differences to FIG. 3 are described.

In FIG. 4, the P filter and the H filter are adaptive filters. The error signal of the P filter is the estimate $\hat{v}'$ of the own voice portion of the inner microphone signal, which should, as explained above, be minimized by the subtraction (55) of the filtered receiver signal from the inner microphone signal. The error signal for the H filter is constituted by the estimate a of the ambient portion of the outer microphone signal that should be minimized, i.e. reduced to the portion of the outer microphone which is uncorrelated with v', by the subtraction of the filtered $\hat{v}'$ from the outer microphone signal.

The P-filter ideally converges towards $\hat{P}$=RM, wherein R is the frequency dependent receiver transfer function and M is the transfer function of the inner microphone. If the influence of the signal path S from the receiver to the inner microphone is not negligible, the P-filter ideally converges towards $\hat{P}$=RSM. The H-filter in this embodiment ideally converges towards $\hat{H}=H_1/H_2 \cdot M_0/M$ where $H_1$ is the acoustic transfer function from the source of the own voice to the outer microphone and $H_2$ is the acoustic transfer function from the source of the own voice to the inner microphone.

Figure 5:
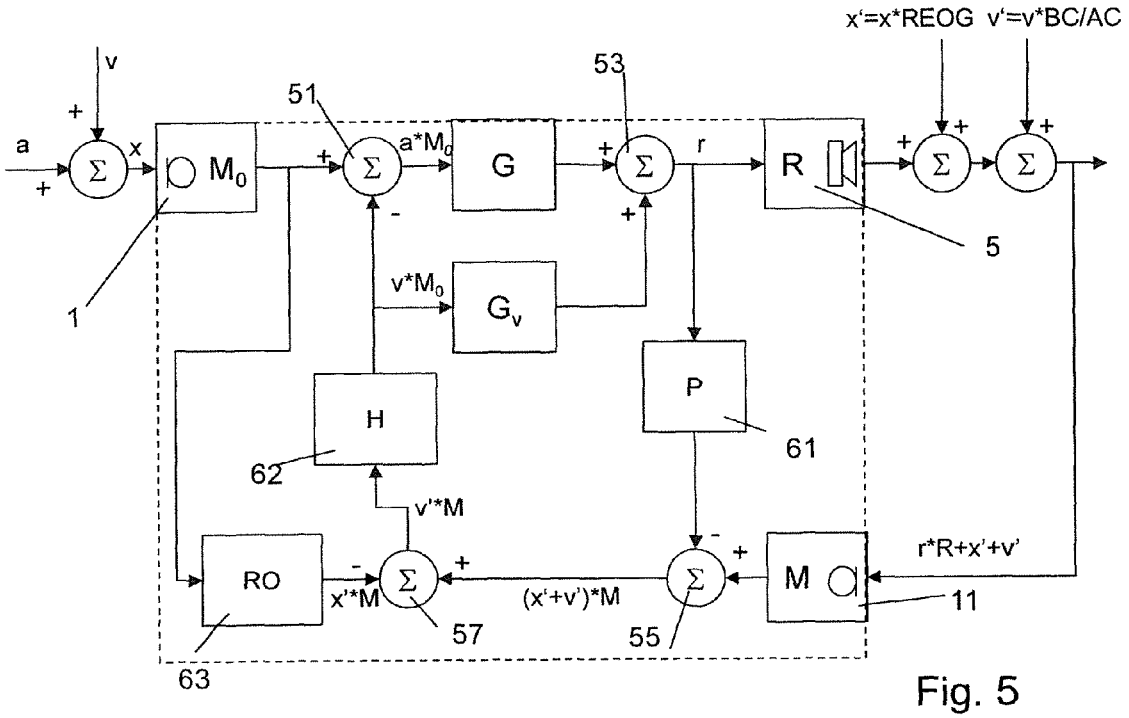
FIG. 5 the situation in which the direct sound that gets directly to the inner microphone, for example through the vent etc. is also taken into account.

FIG. 5 yet depicts the situation in which the direct sound that gets directly to the inner microphone, for example through the vent etc. is also taken into account. The sound x at the outer microphone is, like in the previously described embodiments, the sum of ambient sound a and of own voice v. The sound in the ear canal is the sum of the receiver generated sound signal rR, of the direct sound x'=x*REOG, and of the own voice portion $v'=v*BC/AC=v*H_2/H_1$, where BC denotes bone conduction and AC denotes air conduction (this is assuming that bone conduction from the own voice source to the outer microphone is negligible; in the notation of the previous figures the relation would be $v'=v*H_2/H_1$).

The inner microphone signal is then M*(r*R+x'+v). After subtraction of the P-filtered receiver signal (P-filter 61) that has ideally the filter function P=RM the remaining signal is M*(x'+v'). A third filter 63 may be used to subtract the direct sound portion from this (subtraction 57); the third filter has ideally the filter function $RO=REOG*M/M_0$, where REOG is the real ear occluded gain. What remains is v'*M, and this is filtered in the H-filter 62 to yield $v*M_0$, which quantity, being the own voice portion of the outer microphone signal $x*M_0$, is subtracted from $x*M_0$ to yield the ambient sound portion $a*M_0$ of the outer microphone signal.

The distinct processing paths for the ambient sound portion $a*M_0$ and the own voice portion $v*M_0$ of the outer microphone signal—via gain models G, $G_v$—are analogous to the other embodiments described herein before.

Figure 6:
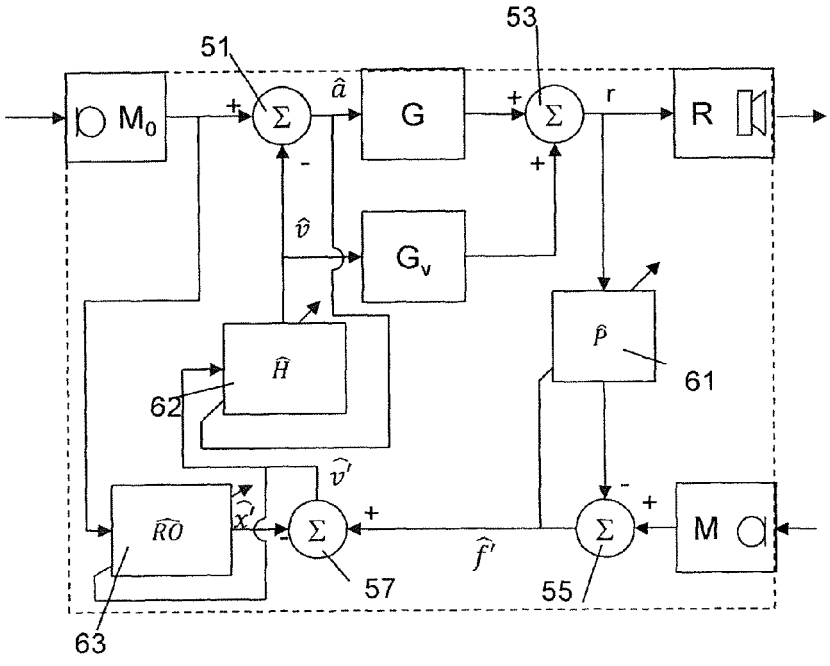
FIG. 6 an embodiment with correction for direct sound.

FIG. 6 shows an implementation based on adaptive P, H, and RO filters $\hat{P}$, $\hat{H}$, and $\hat{R}$O taking into account the direct sound. The subtraction 55 of the P-filtered receiver signal from the outer microphone signal yields an estimate $\hat{f}'$ of the portions (x'+v')*M of the inner microphone signal that are not caused by the receiver sound, and this estimate serves as the error signal for the P filter. An estimate $\hat{x}'$ of the direct sound portion of the inner microphone signal is obtained by applying the third filter (REOG filter; RO) 63 on the outer microphone signal. This estimate $\hat{x}'$ is subtracted from $\hat{f}'$ to yield the estimate $\hat{v}'$ of the own voice portion of the inner microphone signal, whereafter the latter is processed like in the embodiment of FIG. 4. Ideally, the first, second and third filters 61, 62, 63 converge towards RM (or RSM), $AC/BC*M_0/M$, and $REOG*M/M_0$, respectively.

As an alternative, the estimate $\hat{x}'$ may be subtracted prior to the subtraction of the P-filtered receiver signal (exchange of 55 and 57 with respect to each other).

As other alternatives, one or more of the filters, for example the REOG filter 63 may be static while the other filter(s) are/is adaptive. Different combinations of adaptive and static filters may be used.

In the embodiments of FIGS. 3 and 4, the filters P, H and the associated adders 51, 55 may be viewed to constitute the signal separator; in FIG. 6 the signal separator additionally comprises the third filter RO and the corresponding adder 57.

Various other embodiments may be envisaged. For example, prior to being fed to the receiver, the sum signal can be subject to further processing steps. Also, the outer microphone signal may, prior to being fed to the signal separator, subject to other processing steps.

What is claimed is:

1. A method of processing a signal in a hearing instrument, the hearing instrument comprising at least one outer microphone oriented towards the environment, an inner microphone oriented towards the user's ear canal, and at least one receiver capable of producing an acoustic signal in the ear canal, the method comprising the steps of:

Processing an outer microphone signal from the outer microphone and an inner microphone signal from the inner microphone to yield an ambient sound portion signal estimate and an own voice sound portion signal estimate;

Processing the ambient sound portion signal estimate into a processed ambient sound portion signal;

Processing the own voice sound portion signal estimate into a processed own voice sound portion signal;

Adding the processed ambient sound portion signal and the processed own voice portion signal for producing the acoustic signal in the ear canal.

2. The method according to claim 1, wherein the step of processing an outer microphone signal and an inner microphone signal comprises obtaining an own voice signal portion estimate and subtracting the own voice signal portion estimate from the outer microphone signal to yield the ambient sound signal portion.

3. The method according to claim 1, wherein the step of processing an outer microphone signal and an inner microphone signal comprises using at least one adaptive filter.

4. The method according to claim 3, wherein an error signal for the adaptive filter is constituted by a difference between a signal obtained from the outer or inner microphone and the output of the respective adaptive filter.

5. The method according to claim 1, wherein for obtaining an estimate of the own voice portion of the inner microphone signal, the filtered receiver signal is subtracted from the inner microphone signal.

6. The method according to claim 5, wherein the receiver signal is filtered by a first adaptive filter, and wherein a result of the subtraction of the filtered signal from the inner microphone signal serves as an error signal for the first adaptive filter.

7. The method according to claim 1, wherein for obtaining an estimate of the own voice portion of the outer microphone signal, an estimate of the own voice portion of the inner microphone signal is filtered.

8. The method according to claim 7, wherein for filtering the inner microphone signal, a second adaptive filter is used, and wherein a result of a subtraction of the filtered signal from the outer microphone signal serves as an error signal for the second adaptive filter.

9. The method according to claim 1, wherein the step of processing an outer microphone signal and an inner microphone signal comprises estimating a direct sound portion of the inner microphone signal, filtering the estimate of the direct sound portion of the inner microphone, and subtracting the filtered estimate from the outer microphone signal.

10. The method according to claim 1, wherein the step of processing an outer microphone signal and an inner microphone signal comprises source separation.

11. A hearing instrument comprising at least one outer microphone oriented towards the environment, an inner microphone oriented towards the user's ear canal, and at least one receiver capable of producing an acoustic signal in the ear canal, the hearing instrument further comprising a signal processing unit operatively to connected to the at least one outer microphone, to the inner microphone, and to the receiver for processing sound signals from the inner microphone and from the outer microphone and for obtaining a receiver signal for the receiver, the signal processing unit comprising a signal separator equipped and programmed to process an outer microphone signal from the outer microphone and an inner microphone signal from the inner microphone to yield an ambient sound portion signal estimate and an own voice sound portion signal estimate;

the signal processing unit further comprising an ambient sound signal portion processing path and an own voice sound signal portion processing path, the ambient sound signal portion processing path and the own voice sound signal portion processing path being programmed to process the ambient sound portion signal estimate and the own voice portion signal estimate independently, the signal processing unit further being equipped sum the processed signals from the ambient sound signal portion processing path and from the own voice sound signal portion processing path for obtaining the receiver signal.

12. The hearing instrument according to claim 11, wherein the signal separator comprises at least one filter.

13. The hearing instrument according to claim 12, wherein the filter or at least one of the filters is an adaptive filter.

14. A method of configuring a hearing instrument according to claim 11, comprising the steps of instructing a user wearing the hearing instrument to speak, and of adapting a processing parameter of the own voice sound portion processing path dependent on the perception by the user of his own voice.

* * * * *

UNITED STATES PATENT AND TRADEMARK OFFICE

CERTIFICATE OF CORRECTION

PATENT NO. : 9,271,091 B2
APPLICATION NO. : 14/442820
DATED : February 23, 2016
INVENTOR(S) : Thomas Zurbrugg It is certified that error appears in the above-identified patent and that said Letters Patent is hereby corrected as shown below:

On the Title Page

Item [71], replace “Phonak AG” with -- Sonova AG --.

Signed and Sealed this
Twenty-ninth Day of August, 2017

Joseph Matal

Joseph Matal
*Performing the Functions and Duties of the*
*Under Secretary of Commerce for Intellectual Property and*
*Director of the United States Patent and Trademark Office*